US007958574B1

(12) United States Patent
Bodeen et al.

(10) Patent No.: US 7,958,574 B1
(45) Date of Patent: Jun. 14, 2011

(54) UPPER TRUNK PROTECTOR AND RELATED METHODS

(76) Inventors: Keith Bodeen, Dana Point, CA (US); James Kerr, San Clemente, CA (US)

( * ) Notice: Subject to any disclaimer, the term of this patent is extended or adjusted under 35 U.S.C. 154(b) by 0 days.

(21) Appl. No.: 11/417,849

(22) Filed: May 4, 2006

(51) Int. Cl.
*A41D 13/00* (2006.01)

(52) U.S. Cl. ..... 2/467

(58) Field of Classification Search ..... 2/455, 463, 2/467, 102, 69, 94, 44, 45, 2.5, 92, 459
See application file for complete search history.

(56) References Cited

U.S. PATENT DOCUMENTS

| | | | | | |
|---|---|---|---|---|---|
| 3,521,623 | A | | 7/1970 | Nichols et al. | |
| 4,413,832 | A | * | 11/1983 | Pendleton | 280/845 |
| 4,559,933 | A | | 12/1985 | Batard et al. | |
| 4,830,245 | A | * | 5/1989 | Arakaki | 224/628 |
| 4,993,409 | A | | 2/1991 | Grim | |
| 5,011,334 | A | * | 4/1991 | Vorhauer | 405/186 |
| 5,256,135 | A | | 10/1993 | Avihod | |
| 5,486,013 | A | * | 1/1996 | Kilk et al. | 280/18.1 |
| 5,548,843 | A | | 8/1996 | Chase et al. | |
| 5,619,747 | A | * | 4/1997 | Boisclair et al. | 2/465 |
| 5,628,721 | A | | 5/1997 | Arnold et al. | |
| 5,632,723 | A | | 5/1997 | Grim | |
| 5,656,020 | A | | 8/1997 | Greengarg | |
| 5,776,087 | A | | 7/1998 | Nelson et al. | |
| 5,902,073 | A | * | 5/1999 | Eungard et al. | 405/187 |
| 5,983,407 | A | | 11/1999 | McKay | |
| 6,068,606 | A | | 5/2000 | Castel et al. | |
| 6,117,096 | A | | 9/2000 | Hassard | |
| 6,120,213 | A | | 9/2000 | Stinton | |
| 6,331,170 | B1 | | 12/2001 | Ordway | |
| 6,345,396 | B1 | * | 2/2002 | Schuler | 2/467 |
| 6,391,669 | B1 | * | 5/2002 | Fasano et al. | 438/18 |
| 6,766,532 | B1 | * | 7/2004 | Cabana | 2/44 |
| 6,772,439 | B1 | * | 8/2004 | McMullen, Jr. | 2/46 |
| D501,582 | S | | 2/2005 | Yang | |
| 6,925,652 | B2 | * | 8/2005 | Feng | 2/2.15 |

OTHER PUBLICATIONS http://www.plumberspad.com/products.htm.

* cited by examiner

*Primary Examiner* — Tejash Patel
(74) *Attorney, Agent, or Firm* — J. Mark Holland & Associates

(57) ABSTRACT

A back protector having a back plate configured to, among other things, relieve, reduce, or eliminate the stress or discomfort that can be imposed on a person's upper trunk region during certain activities. The protected areas can include the upper back, spine, and/or lower shoulder area of a person, such as a plumber, in the supine position. The upper trunk protector further includes apparatus or means for attaching the plate to the person to be protected, such as a first elongate strap and a second elongate strap each having a first end and a second end, and a waist belt. Preferably, the waist belt is attached along a bottom portion of the back plate and is configured to be worn about the person's waist, while the first elongate strap and second elongate strap are each attached at the first end to a top section of the back plate and at the second end to corresponding points on the waist belt. Related methods are described.

7 Claims, 11 Drawing Sheets

UPPER TRUNK PROTECTOR AND RELATED METHODS

FIELD OF THE INVENTION

The invention relates generally to a body protection device, and specifically to a device for protecting the upper trunk region of a person, including a portion of the upper back, spine and/or lower shoulder area, from injury and/or discomfort while in a supine position.

BACKGROUND OF THE INVENTION

According to one source, back injuries are the nation's number one workplace safety problem. The Bureau of Labor Statistics (BLS) estimates that more than one million workers suffer back injuries each year, and back injuries account for approximately twenty-five percent (25%) of all disabling work injuries, as well as one-fourth of all compensation indemnity claims in the United States.

Moreover, the BLS survey shows that four out of five (80%) of these injuries were to the lower back, and that three out of four (75%) occurred while the employee was lifting. The other twenty-percent (20%) of back injuries presumably occurred to the upper back, including the spine and lower shoulder region. Such back injuries and the associated upper trunk pain and discomfort may include those sustained by persons such as plumbers, who frequently work under sinks in the supine position for extended periods of time with their backs against the sharp lower outer edge of a cabinet.

No approach has been found for totally eliminating back injuries, though it is felt that a substantial portion of these injuries can be prevented by an effective control program, including equipment specifically design for the protection and/or the prevention of back injuries, and an ergonomic plan of work tasks.

In this regard, an increasing number of persons use back belts to try to prevent lower back injuries. Researchers noted that about 4 million back belts were purchased in 1995 alone to try to prevent lower back injuries.

Accordingly, there exists a need for a device for protecting the upper trunk region of a person, including a portion of the upper back, spine and/or lower shoulder area, from injury and/or discomfort while in a supine position.

SUMMARY OF THE INVENTION

The invention is directed to apparatus and methods to, among other things, relieve, reduce, or eliminate the stress or discomfort imposed on the upper trunk region, including the upper back, spine and/or lower shoulder area of person such as a plumber while in the supine position.

In one embodiment, the upper trunk protector includes a back plate configured to protect the upper trunk region of a person while in a supine position; a first elongate strap and a second elongate strap each having a first end and a second end; and a waist belt. Preferably, the waist belt is attached along a bottom portion of the back plate and is configured to be worn about the person's waist, and the first elongate strap and second elongate strap are each attached at the first end to a top section of the back plate and at the second end to corresponding points on the waist belt.

For the purpose of summarizing the invention certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group or advantages as taught herein without necessarily achieving other objects or advantages as may be taught or suggested herein.

These and other embodiments will become readily apparent to those skilled in the art from the following detailed description of the various embodiments having reference to the attached figures, the invention not being limited to any particular preferred embodiment(s) disclosed.

DETAILED DESCRIPTION

Figure 1:
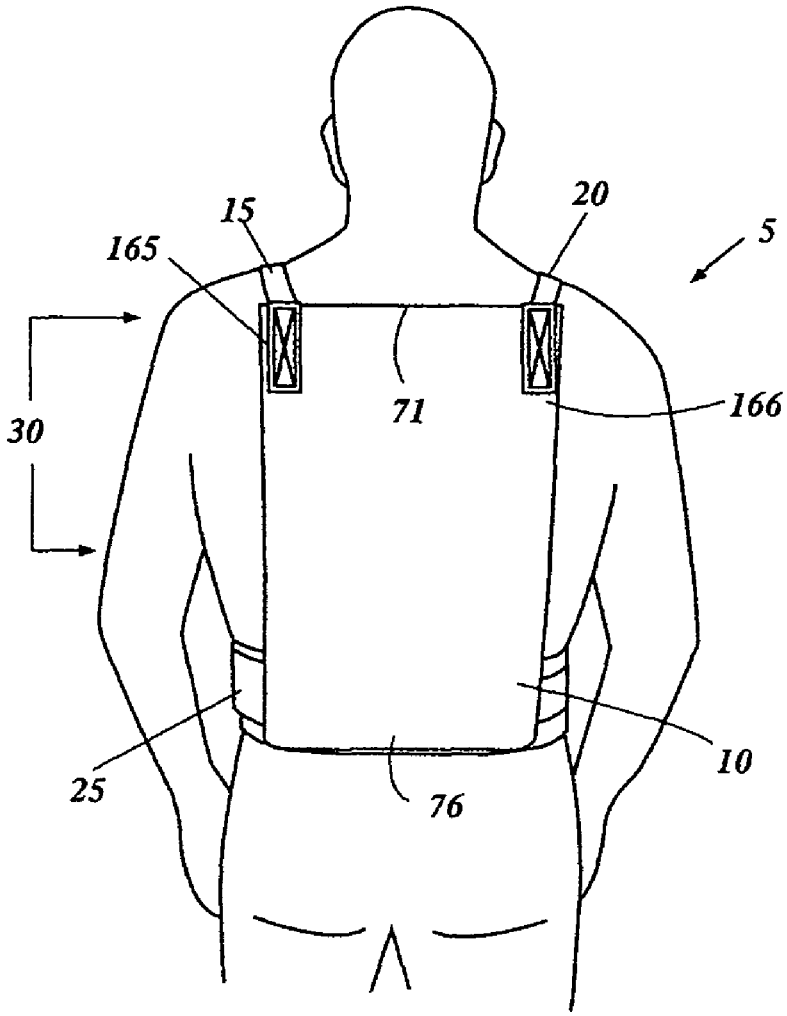
FIG. 1 shows the upper truck protector positioned on a person to protect the upper trunk region, including a portion of the upper back, spine, and/or shoulder area in accordance with one embodiment of the present invention.

Embodiments of the present invention will now be described with references to the accompanying Figures, wherein like reference numerals refer to like elements throughout. The terminology used in the description presented herein is not intended to be interpreted in any limited or restrictive manner, simply because it is being utilized in conjunction with a detailed description of certain embodiments of the invention. Furthermore, various embodiments of the invention (whether or not specifically described herein) may include novel features, no single one of which is solely responsible for its desirable attributes or which is essential to practicing the invention herein described.

Figure 7A:
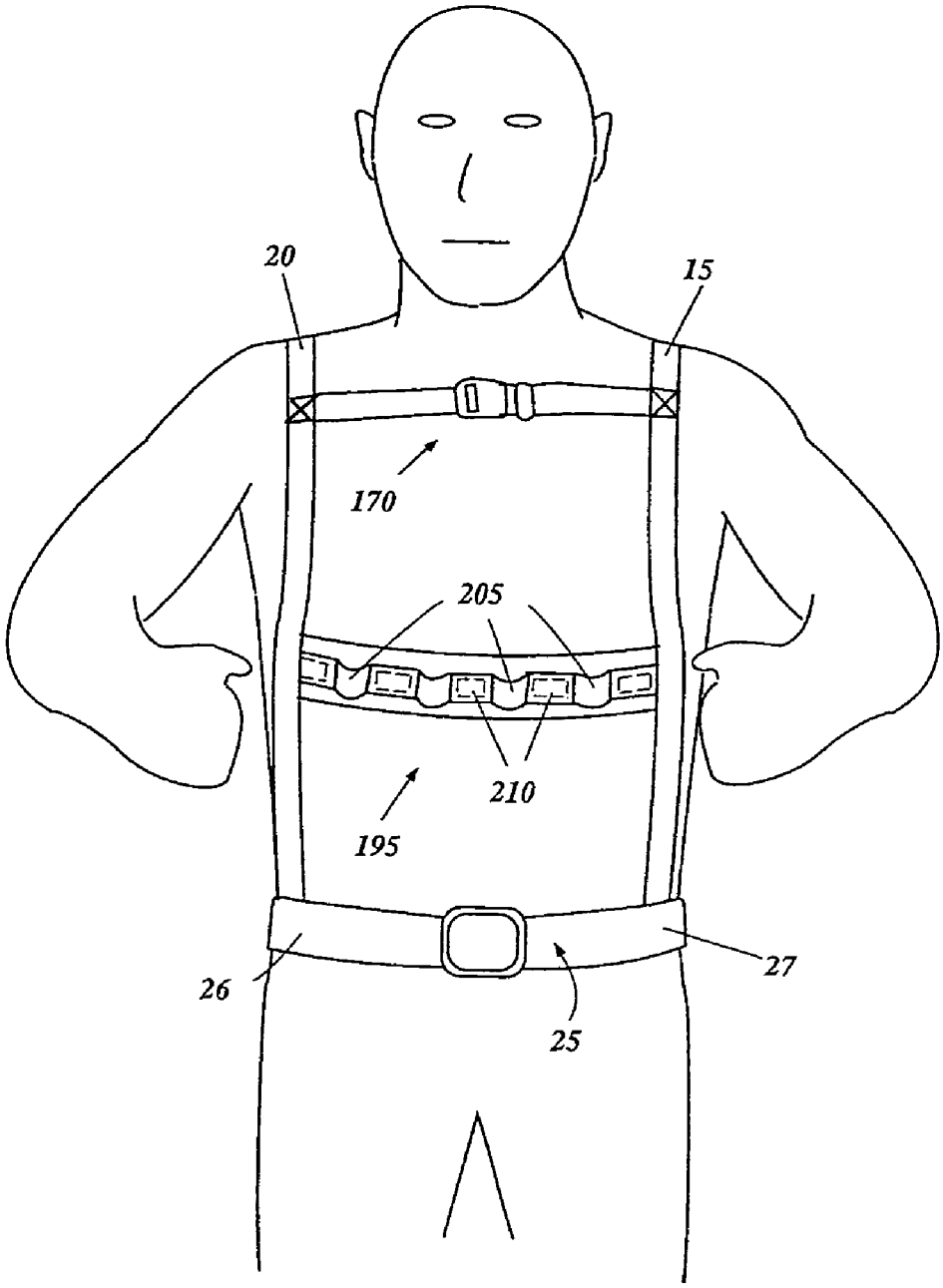
Figure 7B:
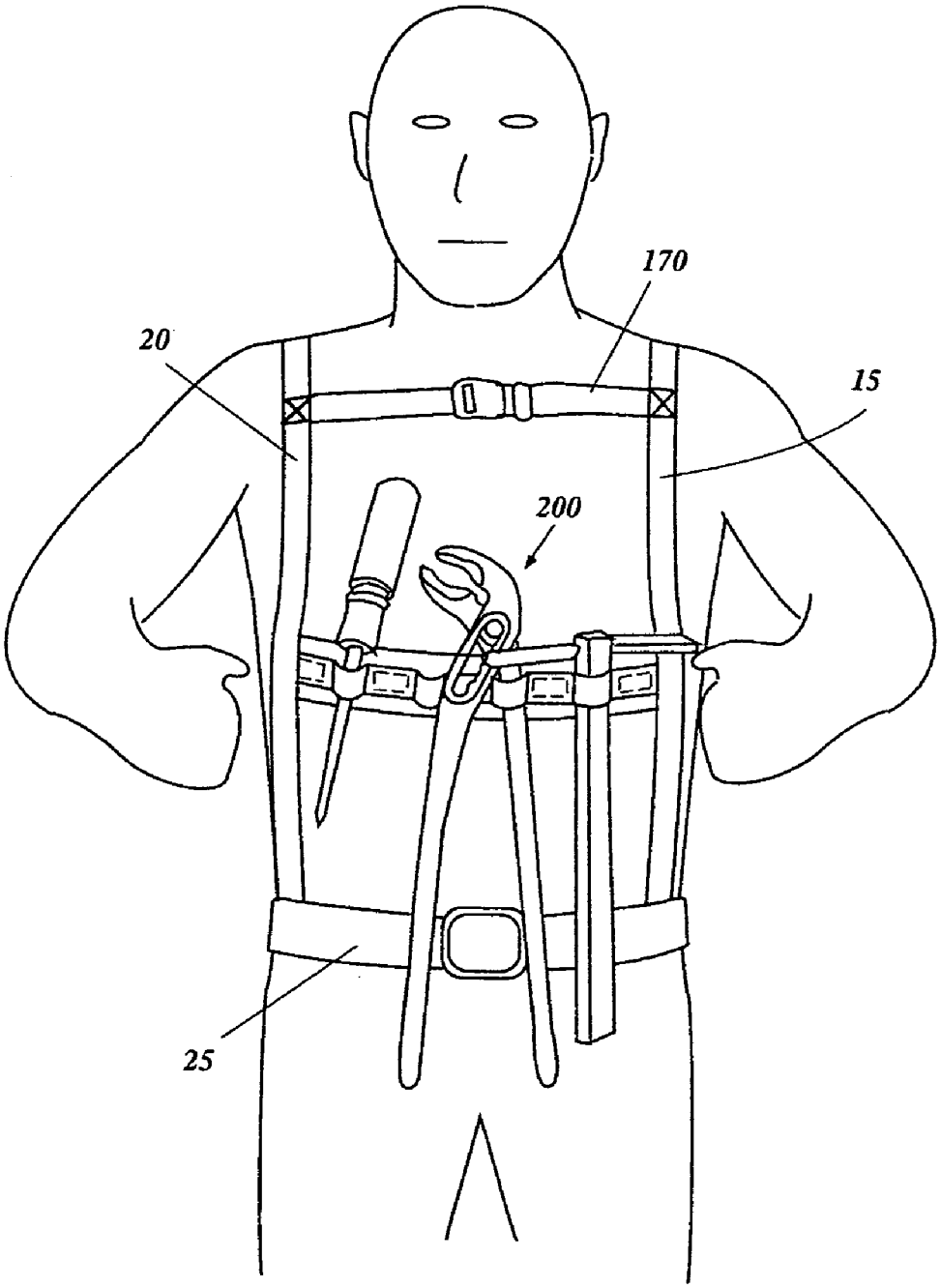

As shown in FIG. 1, in one embodiment, the body protection device or upper trunk protector 5 preferably includes a generally flat or planar back plate, board, or body portion 10 having upper elongate straps 15, 20 each having a first end 16, 17 extending therefrom and a second end 18, 19 (FIG. 2) attached to a corresponding point 26, 27 (FIG. 7(*a*)) on a waist belt 25 for removably retaining the back plate 10 to an upper trunk region 30 of a person. In this regard, a person preferably wears the device like a backpack.

Figure 4:
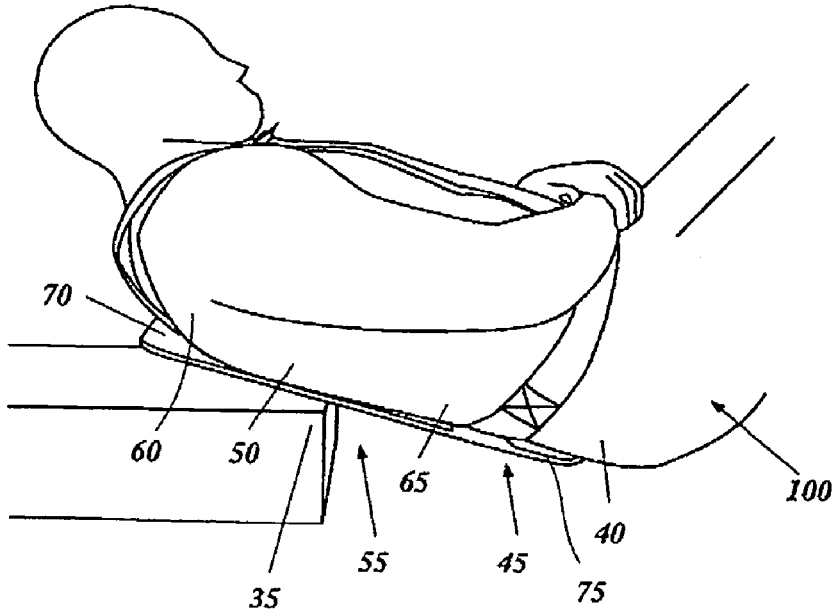
FIG. 4 shows a person in a supine position wearing the upper truck protector of FIGS. 3(*a*)-(*b*).

The upper trunk protector 5 is primarily intended to relieve, reduce, or eliminate the stress or discomfort imposed on a person's upper trunk region 30 while in the supine position. For example, as shown in FIG. 4 plumbers are frequently on their backs under a kitchen or bathroom cabinet for extended periods of time servicing or installing among other things a plumbing fixture. While in this position, the plumber is particularly prone to back stress or discomfort as the raised lower outer edge of the cabinet 35 typically presses into the plumber's unprotected upper trunk region 30. In order to alleviate or reduce the pain or discomfort to their upper trunk region 30, plumbers (or anyone else in the same position) often plant their feet and elevate their hips 40 to approximately the same level as the raised lower outer edge of the cabinet 35. Although this technique acts to reduce the associated upper back/shoulder pain, it typically brings on discomfort or fatigue in the hips 40 or lower back area 45. Accordingly, use of the device as described herein serves to protect the upper trunk region 30 of a person, including a portion of the upper back 50, spine 55 (corresponding to the upper back) and/or lower shoulder area 60, from injury and/or discomfort while in a supine position.

The back plate 10 is preferably constructed of a material resilient enough to protect the person's upper trunk 30 by distributing at least a portion of the pressure generally encountered when in the supine position, as described above. Such materials may include plastic, wood, metal, composites, or a similar type material that may permit (depending on thickness) for some flexing of the material when being used for its intended purpose.

The back plate 10 is configured (i.e., shaped and sized) to be positioned and worn so as to protect at least the upper trunk region 30 of a person, including a portion of the upper back 50, spine 55 (corresponding to the upper back) and/or lower shoulder area 60. Persons of ordinary skill in the art will understand that the size and shape or dimensions of the back plate 10 may vary according to, among other things, the wearer's body proportions. For example, the average woman's upper trunk is relatively smaller in width and length when compared to the average man's upper trunk dimensions. Even within the same gender type body proportions may vary greatly. The user's style choice, and/or the device's performance and/or comfort preferences may dictate other back plate size and shape considerations.

Figure 5:
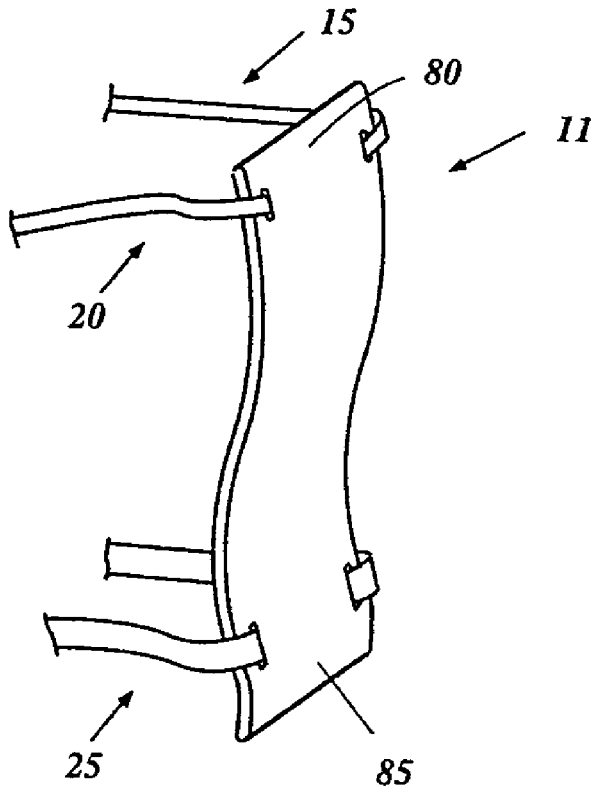
FIG. 5 shows a curved embodiment of the upper back protector to preferably conform to the shape of a portion of the user's spine and lumbar region.

For example, in one embodiment, as shown in FIGS. 1-4, the back plate 10 is relatively flat while the back plate 11 shown in FIG. 5 is curved to preferably conform to the shape of a portion of the user's spine 55 and lumbar region 65. In this regard, in contrast to the relatively flat back plate 10 that typically makes contact with a portion of the wearer's upper trunk 30 along a top section 70 and bottom section 75 of the back plate 10, the curved back plate 11 may provide an additional measure of comfort and/or protection for some individuals (as it is intended to make contact with the upper trunk region 30 of the wearer's anatomy along substantially its entire length from top 80 to bottom 85).

Figure 6A:
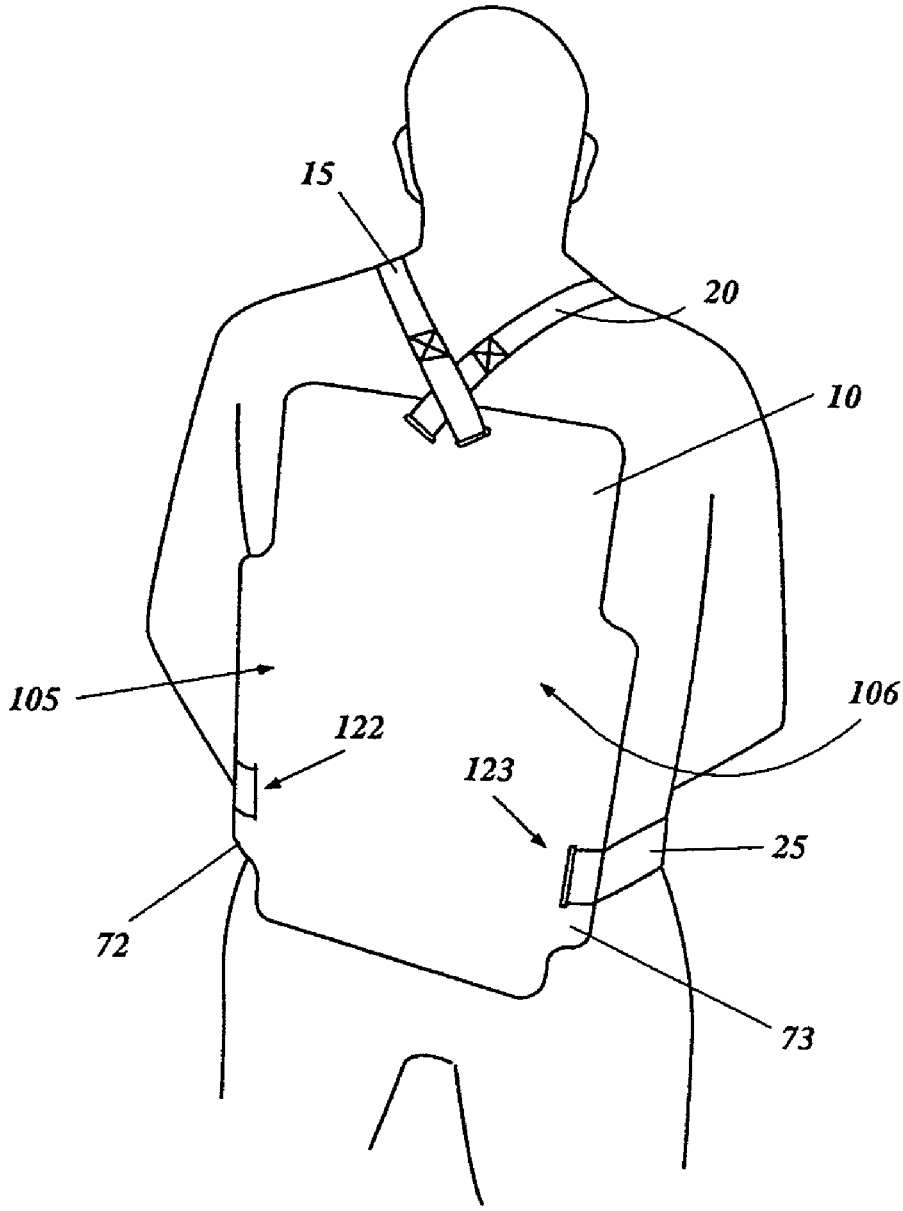
FIGS. 6(*a*)-(*b*) show another embodiment of the upper back protector having protruding side portions or angled extensions and a raised surface portion or lumbar support section in accordance with another embodiment of the present invention FIGS. 7(*a*)-(*b*) show a utility strap positioned between elongate straps in accordance with another embodiment of the present invention.
Figure 6B:
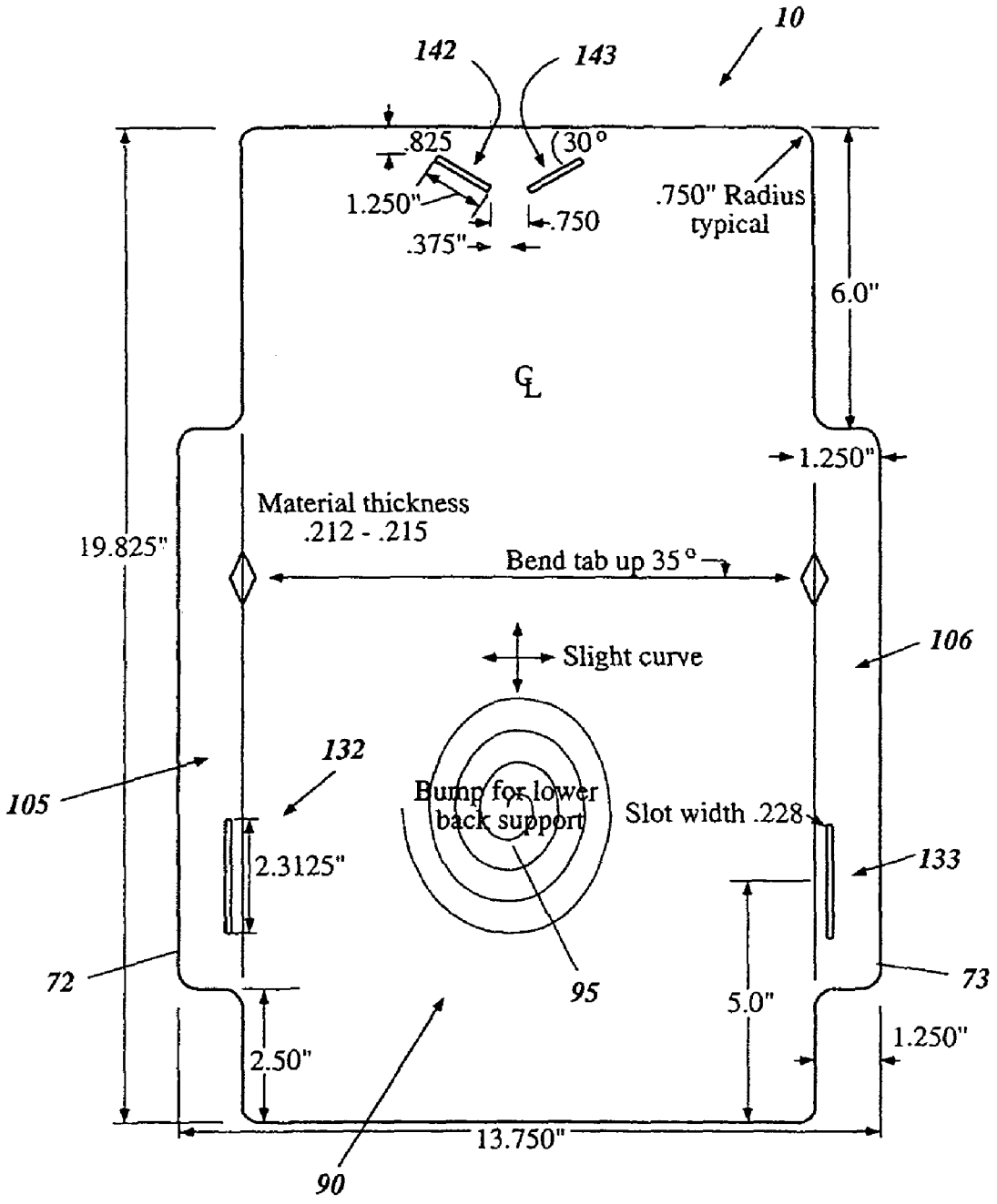

As shown in FIG. 6(*b*), additional comfort and/or support features of the back plate 10 may include a lumbar support section 90. The lumbar support section 90 may consist of a raised surface portion or bump 95 molded or otherwise formed in an area of the back plate 10 corresponding to the lumbar region 65 or lower back area 45 of the wearer when the upper trunk protector 5 is worn for its intended purpose. In an alternative embodiment, the lumbar support section 90 or bump 95 may consist of an air-assisted bladder that may be inflated or deflated according to the wearer's preference. Inflation of the air-assisted bladder may be accomplished by, among other things, a hand pump, while a valve release mechanism may be provided to deflate the lumbar support section 90.

Figure 2:
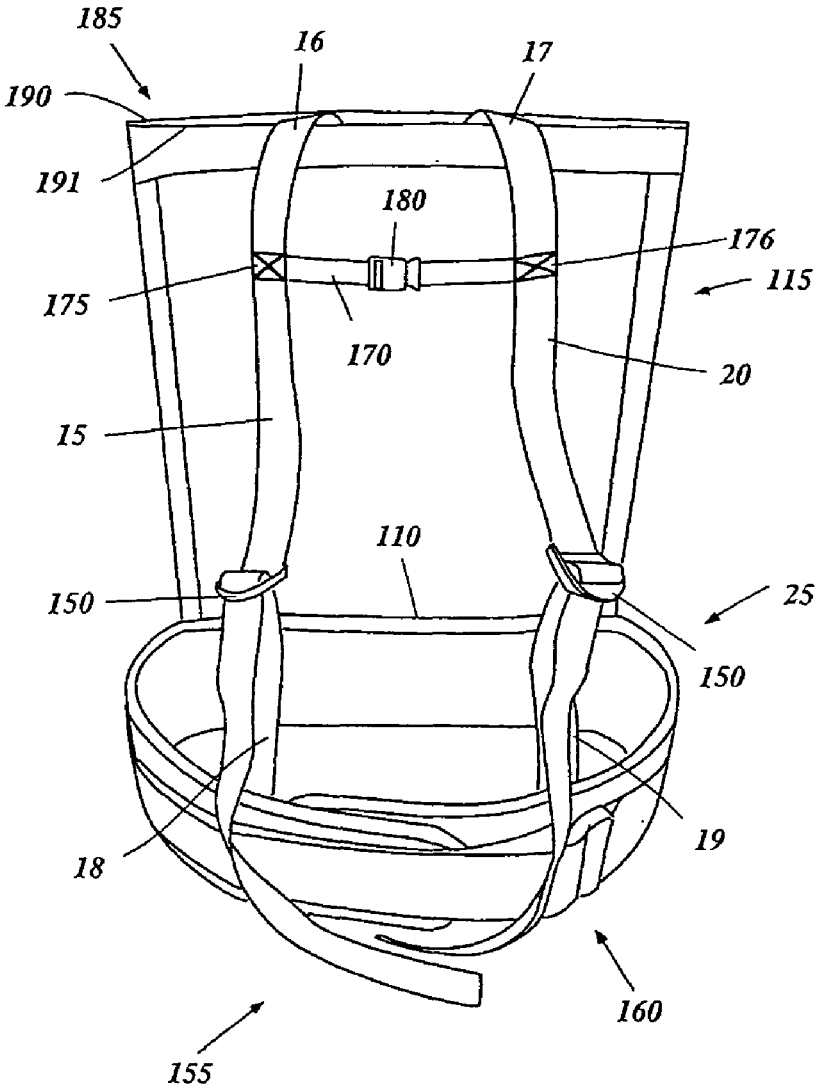
FIG. 2 shows the upper trunk protector having elongate straps, a waist belt, and a back plate cover formed into a pocket to receive a back plate.
Figure 3A:
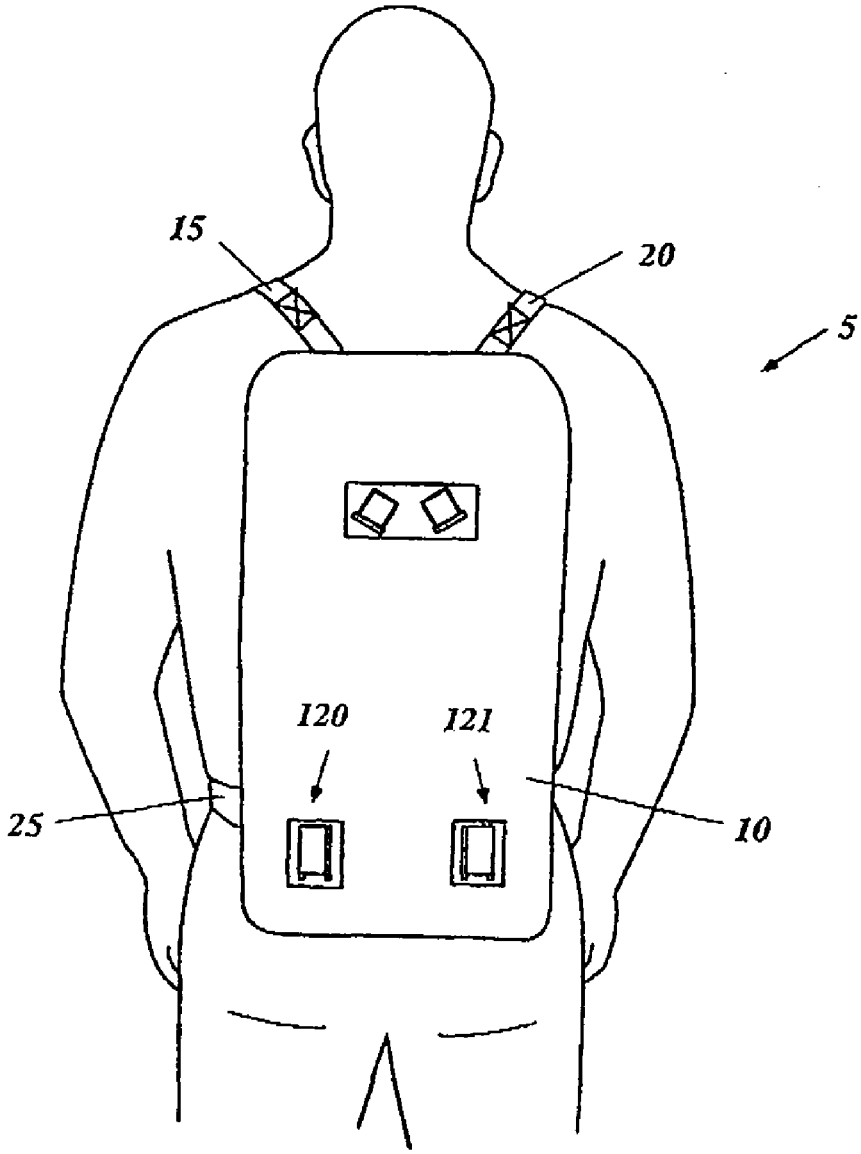
FIGS. 3(*a*)-(*b*) show the upper back protector in accordance with another embodiment of the present invention.
Figure 3B:
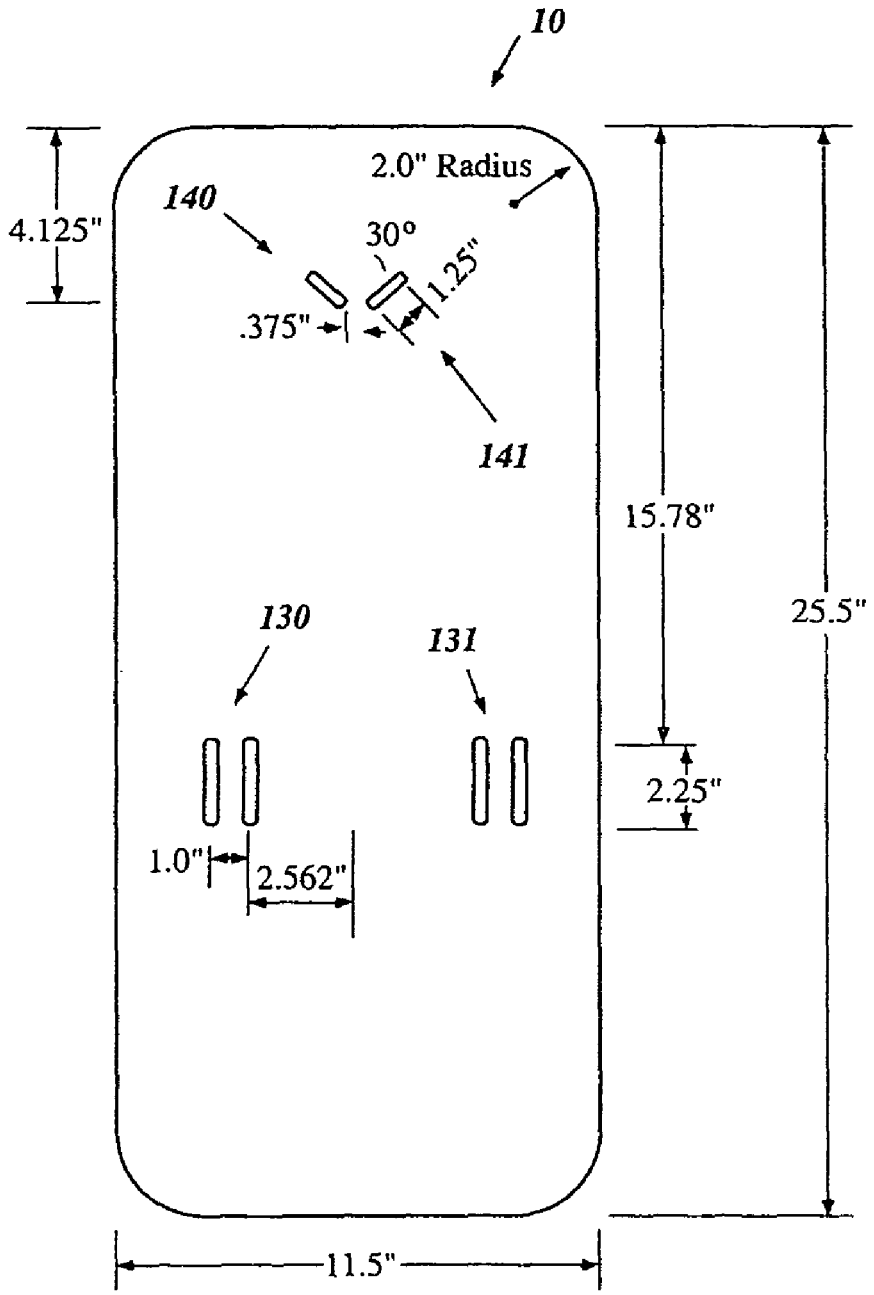

Further in this regard, the back plate 10 of FIGS. 1 and 2 are relatively shorter when measured from the top edge 71 (closer to the user's head) to the bottom edge 76 (nearer the user's buttocks) when compared to the back plate 10 of FIGS. 3-4. In this regard, the pack plate 10 of FIG. 1 is sized smaller so it may be worn, if desired, beneath the clothing of the wearer so as not to be observed by other persons.

As shown in FIG. 4, the longer back plate embodiment is preferably configured so that it extends below the wearer's waist. Accordingly, when a person is in the supine position, the upper section 70 of the back plate contacts the protruding raised lower outer edge of the cabinet 35 to specifically protect at least a portion of the wearer's upper back 50, spine 55 and/or lower shoulder area 60 while the bottom section 75 of the longer back plate embodiment contacts the floor/ground thereby creating a relatively inclined surface for supporting the wearer's upper trunk 30 and buttocks 100. The shorter back plate embodiment of FIG. 1 generally offers the same upper truck 30 protection as the longer back plate embodiment but in a smaller profile that may offer more comfort and maneuverability for some individuals. Use of the shorter back plate embodiment typically requires the wearer to rest his/her buttocks 100 directly on the floor/ground or rise the wearer's hips 40 to lift the wearer's buttocks 100 off the floor.

The back plate 10 shown in FIGS. 6(*a*)-(*b*) is relatively wider along the sides of the back plate 10 when measured from the left edge or side 72 to the right edge or side 73 when compared to the back plate 10 shown in the other figures. Such wider portions or extensions 105, 106 in the back plate 10 configuration may be angled relative to the rest of the back plate 10. Such wider portions or angled extensions 105, 106 along each side 72, 73 of the back plate 10 may increase board stability, assist in keeping the board 10 in place on the wearer's back, or accommodate placement of the upper elongate strap 15, 20 and/or waist belt 25 attachment at various points on the back plate 10.

For example, the waist belt attachment point(s) for the back plate shown in FIGS. 1 and 2 are preferably along an inside surface 110 of the back plate 10. In this regard, a waist belt 25 may be attached directly to the back plate 10 or the waist belt 25 may be sewn, glued, or otherwise attached to a back plate cover 115 so as to provide a relatively smooth outside surface area for the upper back plate protector 5, as shown in FIG. 1. The smooth outside surface profile of the upper back protector 5 generally permits the wearer with greater ease of maneuverability while in the supine position, because the back plate 10 and/or back plate cover 115 is less likely to snag, catch, etc. on the outside lower edge of the cabinet 35 or other obstruction than a back plate (FIG. 3a) without such a relatively smooth outside surface area.

FIGS. 3(*a*)-(*b*) show attachment of the waist belt 25 at inboard portions 120, 121 of the upper back protector 5 while the back plate of FIG. 6(*a*) shows attachment of the waist belt 25 to outboard portions 122, 123 or the outer edge of the back plate 10. Attachment of each the aforementioned waist belts 25 may be provided by one or more slits 130-133 in which the waist belt 25 (preferably constructed of a polyester, nylon, leather, neoprene, or other suitable material, and which may include padded features), is looped or threaded through the slits 130-133 to secure the waist belt 25 in place.

Similar to the waist belt 25, attachment of the upper elongate straps 15, 20 (preferably constructed of polyester, nylon, leather, neoprene, or other suitable material and which may included padded features) to the back plate 10 may be facilitated by one or more slits 140-143 in which the elongate straps 15, 20 are looped or threaded through the slits 140-143 to secure the elongate straps 15, 20 in place.

In one embodiment, a first end 16, 17 of each of the elongate straps 15, 20 is attached along an upper or top section 70 of the back plate 10. After attachment to the back plate 10, the elongate straps 15, 20 preferably are crossed behind the wearer, positioned over the wearer's shoulders, and attached at a second end 18, 19 to corresponding points 26, 27 (FIG. 7(*a*)), on the waist belt 25 in front of the wearer. Like all of the various attachments disclosed and described herein, these can be provided and accomplished by any suitable apparatus or methods. In the embodiment of FIG. 7, attachment of the back plate 10, elongate straps 15, 20 and waist belt 25 to each other positions the back plate 10 (configured in size and shape to correspond to the upper trunk 30 dimensions of the wearer, including the upper back 50, spine 55 (corresponding to the upper back 50), and lower shoulder area 60) on the wearer.

Preferably, the apparatus can be easily adjusted and customized to fit a wide range of users or wearers. For example, adjustment of the elongate straps 15, 20 and/or waist belt 25 may be accomplished by any suitable apparatus or method, such as by providing one or more pull-type connections 150, which are well-known in the art, as shown in FIG. 2. Such adjusters or other connectors such as pull-type connections 150 can be positioned along a section of the elongate strap 15, 20 or waist belt 25, or at any other suitable location. Preferably, a Velcro® pull feature 155 positioned on one end of the waist belt 25 and a corresponding D-ring 160 positioned on the other end of the waist belt 25 facilitates closure of the waist belt 25 around the waist of the wearer. Among the many alternative embodiments of the invention, other closures (not shown) may include a quick release device, buckle, or other well-known closure methods. Crossing the straps, as shown in FIG. 3(*a*), either in back or front of the wearer typically helps prevent the elongate straps 15, 20 from slipping off the wearer's shoulders.

Alternatively, the elongate straps 15, 20 may be attached directly to the back plate 10 (or otherwise attached to a back plate cover 115, as discussed further below) along opposite top outer edges 165, 166 of the back plate 10, by sewing, gluing, or any other suitable method well-known in the art. For example, in the embodiment shown in FIG. 1, the elongate straps 15, 20 are preferably attached at opposite top outer edges 165, 166 of the back plate cover 115 via sewing or similar methods. In this embodiment, one or more supplemental chest straps 170 connecting the elongate straps 15, 20 in front of the wearer may be provided to reduce movement of the elongate straps 15, 20 that may cause the straps 15, 20 to slip or otherwise move off the wearer's shoulders. Opposite ends 175, 176 of the supplemental chest strap 170 may be operatively connected to corresponding elongate straps 15, 20 and to each other in any suitable manner, such as by sewing, by Velcro, by one or more snaps or other quick-disconnect devices 180, or similar type device.

Among the many alternative embodiments of the device is the one mentioned above and shown in more detail in FIG. 2, in which the elongate straps 15, 20 are attached to a top section of a back plate cover 115. In such embodiments, the cover 115 itself preferably can be opened to operatively receive and retain the back plate 10. Thus, the straps themselves do not have to be affixed directly to the back plate, but can be used in embodiments that allow easy customization of the apparatus depending on the physical characteristics of the wearer, the particular task or activity in which the wearer is going to be involved, and other factors.

Such a back plate cover 115 may be constructed of leather, cloth such as Cordura®, or any other suitable material or combination of materials. The cover 115 preferably is configured to removably receive the back plate 10. In the upper trunk protector of FIG. 2, the back plate cover 115 is configured to form a pocket 185 having an opening along a top edge formed by opposite sides 190, 191 of the back plate cover 115. The back plate 10 is sized accordingly and is capable of being received or inserted into the back plate cover pocket 185 and secured in place by a zipper, a Velcro® closure, snaps, string, or other suitable means positioned accordingly to bring opposite sides 190, 191 of the back plate cover pocket 185 together. In one embodiment the back plate cover 115 may include one or more padded sections between the cover and the back plate (not shown) to increase wearer comfort.

Figure 8:
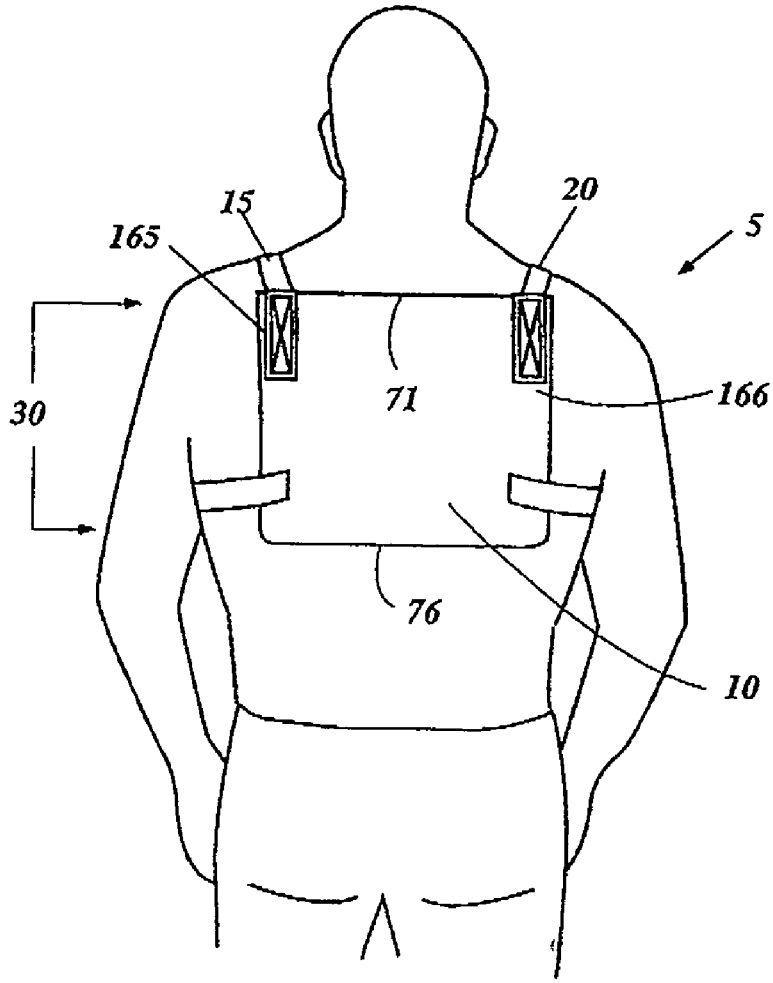
FIG. 8 shows another embodiment of the upper back protector having a back plate of a reduced size in accordance with another embodiment of the present invention.

As shown in FIG. 8, in another embodiment, the back plate 10 may be of a reduced size, however still configured, positioned, and capable of protecting the upper trunk 30. In this regard, a first end 16, 17 of each of the elongate straps 15, 20 may be attached along a top section 70 of the back plate 10. In this embodiment, there is no need for a waist belt 25, because the second end 18, 19 of each elongate strap 15, 20 may be looped under a corresponding armpit of the user and connected again to the back plate 10. To wear this embodiment of the back plate 10, the user slips one arm into a first loop formed by one elongate strap 15 and then slip the other arm into a second loop formed by the other elongate strap 20.

In still another embodiment, as shown in FIG. 7(*a*)-(b), a utility strap 195 may be positioned in front of the user and connected between the elongate straps 15, 20 by any suitable apparatus or method. In this regard, the utility strap 195 is preferably positioned generally near the center of the upper torso of the wearer as opposed to the upper chest positioning that is preferable for the supplemental strap 170. In this regard, the utility strap 195 may serve to replace the supplemental strap 170 as a connection member to assist in holding the elongate straps 15, 20 from moving off the shoulders when the elongate straps 15, 20 are positioned as in FIGS. 1 and 2. However, preferably, the utility strap 195 is constructed to removably receive tools 200 commonly used when performing services such a plumber would perform when in the supine position.

The utility strap 195 preferably includes a plurality of loop members 205 capable removably receiving a variety tools 200 such as pliers, wrench, screwdriver, etc. In this regard, a relatively smaller portion of the tool, such as the tip of a screwdriver, passes through the loop member 205 and is retained in the loop member 205 by a relatively larger portion of the tool such as the handle of the screwdriver. Magnets 210 positioned between loop members 205, Velcro®, or other suitable apparatus and methods may be used to further assist in retaining the tools 200 in the loop members 205 while the tools are not in use.

Other features of the upper back protector 5 not shown may include a padded headrest attached to the back plate 10 or back plate cover 115. The headrest may be inflatable and/or removable to increase styling or performance options of the upper back protector 5. Similarly, a light source, preferably a flexible goose-neck type, may further be included and attached to the back plate 10, back plate cover 115, or one of the elongate 15, 20, supplemental 170, or utility straps 195.

The apparatus and methods of the present invention have been described with some particularity, but the specific designs, constructions and steps disclosed are not to be taken as delimiting of the invention. Obvious modifications will make themselves apparent to those of ordinary skill in the art, all of which will not depart from the essence of the invention and all such changes and modifications are intended to be encompassed within the appended claims.

What is claimed is:

1. A safety system for working under kitchen sinks and the like, comprising:

a plate sized and shaped to be generally positioned against a wearer's back, an exposed edge generally at a lower front lip of a cabinet, said edge being sufficiently wide and having an open space above it to permit the insertion of at least an upper portion of the wearer's body, said plate having a back surface positioned generally away from the wearer and a front surface generally toward the wearer's back, said back surface configured and positionable between the wearer's back and the exposed edge while the worker is in a supine position with at least an upper portion of the wearer's body inserted into the cabinet;

said back surface of said plate further being substantially flat and hard and providing a substantially smooth exterior to permit sliding of said surface across said edge; and means for attaching the plate to the wearer, said attachment means including a first elongate strap and a second elongate strap and a waist belt, the waist belt being attached generally to a bottom portion of the plate and configured to be worn about the waist of the wearer, and the first elongate strap and second elongate strap are each attached to respective locations on a top section of the plate and configured to engage the wearer's torso to assist in securing the device to the wearer.

2. The system of claim 1, wherein the plate is curved to generally conform to the shape of the spine and lumbar region of the wearer.

3. The system of claim a 1, wherein the plate includes a lumbar support section formed in an area corresponding to the lumbar region of the wearer when the plate is worn for its intended purpose.

4. The system of claim 3, wherein the lumbar support section is an air-assisted bladder.

5. The system of claim 1, further including a utility strap positioned in front of the wearer connected between the first elongate strap and second elongate strap, the utility strap being configured to removably retain tools.

6. The system of claim a 1, wherein the plate includes a relatively wider portion along a section of each side of the plate.

7. The device of claim 1, wherein the first ends of said first elongate strap and said second elongate strap are each attached to the top section of the back plate through corresponding slits for receiving the straps, and wherein said slits for receiving the straps are positioned at an angle other than 90° to a horizontal edge of the back plate.

* * * * *